US005568367A

United States Patent [19]

Park

[11] Patent Number: 5,568,367

[45] Date of Patent: Oct. 22, 1996

[54] REMOTE CONTROL WITH KEY LIGHTING

[75] Inventor: Young M. Park, Seoul, Rep. of Korea

[73] Assignee: Universal Electronics Inc., Twinsburg, Ohio

[21] Appl. No.: 359,472

[22] Filed: Dec. 20, 1994

[30] Foreign Application Priority Data

Jun. 8, 1994 [KR] Rep. of Korea ..... 13251

[51] Int. Cl.[6] ..... F21V 33/00

[52] U.S. Cl. ..... 362/109; 362/30; 362/85; 362/234; 362/251; 200/314

[58] Field of Search ..... 200/310, 313, 200/314, 317; 362/23, 24, 29, 85, 109, 30, 251, 234

[56] References Cited

U.S. PATENT DOCUMENTS

| | | | |
|---|---|---|---|
| 4,343,975 | 8/1982 | Sado | 200/314 |
| 4,354,077 | 10/1982 | McMains et al. | 200/314 |
| 4,365,120 | 12/1982 | Pounds | 200/314 |
| 4,531,034 | 7/1985 | Inaba | 200/314 |
| 4,710,597 | 12/1987 | Loheac | 200/314 |

FOREIGN PATENT DOCUMENTS

| | | | |
|---|---|---|---|
| 554084 | 8/1993 | European Pat. Off. | 200/313 |

*Primary Examiner*—Denise L. Gromada
*Assistant Examiner*—Alan B. Cariaso
*Attorney, Agent, or Firm*—Thomas R. Vigil

[57] ABSTRACT

The hand held, battery operated remote control with key lighting for controlling an appliance from a remote location comprises: a housing having openings through an upper wall thereof; a plurality of transparent or translucent push-buttons each extending upwardly through one of the openings; one of the push-buttons being a light actuation button; a plurality of switches each associated with one of the push-buttons; a light emitting circuit located inside the housing and including at least one light emitting element positioned in the housing at a location not under a push button, light dispersing structure for illuminating one or more of the push-buttons with light from the at least one light emitting element, and circuitry for maintaining the light emitting circuit activated for a short period of time after said one of the switches is closed by depression of the light actuation button.

16 Claims, 4 Drawing Sheets

REMOTE CONTROL WITH KEY LIGHTING

BACKGROUND OF THE INVENTION

1. Field of the Invention

The present invention relates to a remote control with key lighting to enable a user of the remote control easily to distinguish characters, numbers and symbols of keys or push-buttons on a keyboard of the remote control that are indicative of functions performable upon depression of those keys, the key lighting being provided at night or in a dark place by light emitted from light emitting elements in the remote control.

2. Description of the Prior Art

Generally, remote controls are used to remotely control various household electric appliances or mechanisms at a remote place by use of a variety of frequencies, pulse codes and electric waves including radio waves and infra-red light pulse sequences. For a convenient use, a remote control may be additionally provided with control buttons to have various additional functions. As a result, the remote control may have a complex construction. In spite of such a complex construction, there is no difficulty to manipulate the remote control in a lighted place because characters, numbers and symbols, indicative of functions which can be performed upon depression of the control keys or push-buttons easily can be distinguished. In a dark place, however, it is difficult for a user to find a desired key or button from a number of control keys or buttons. Therefore, it is desirable to provide a remote control capable of being easily manipulated even in a dark place.

Heretofore, various devices have been proposed for attachment to a remote control for illuminating the keys thereof. Examples of such devices and remote controls are disclosed in the following U.S. patents:

| U.S. Pat. No. | PATENTEE |
|---|---|
| 4,905,127 | Kaminski |
| 4,949,230 | Burmeister |
| 5,010,462 | Mintzer |
| 5,055,977 | Acquanetta |
| 5,063,484 | Tanaka |
| 5,122,937 | Stoudemire |
| 5,172,974 | Riban |
| 5,183,325 | Hurdle |
| 5,188,448 | Siriani et al. |
| 5,203,622 | Sottile |
| 5,205,637 | Caspari |

A typical prior art remote control comprises a housing including a lower case having a circuit board laid on the lower case and a contact plate disposed on the circuit board and adapted to have contacts thereon pressed against contacts on the circuit board for selectively establishing closed circuits on the circuit board. On the contact plate, a key or button fixing plate and a rubber plate having a plurality of keys or buttons are seated. The key or button fixing plate guides the buttons to cause a selected contact accurately to come into corresponding contact with a selected contact on the circuit board. The housing also includes an upper case disposed over the rubber plate. Through the upper case, the keys or buttons protrude upwardly. In the conventional remote control having the construction described above, it is very difficult to find a desired key or button in a dark place without using a separate lighting appliance.

Many of the U.S. patents referred to above are directed to some form of device having a keyboard lighting system and structure for attachment of the device to a remote control in an attempt to solve this problem.

The Tanaka U.S. Pat. No. 5,063,484 discloses a remote control unit comprising a body case or housing including side riser portions at least one of which has a light admitting hole. Between the riser portions, the case has a recess including a floor having holes through which push-button switches extend upwardly. A door is provided which has corresponding push-buttons and which is mounted for pivotal movement from a closed position that is in the recess between the riser portions and adjacent the floor, and is a position where light is projected into a light conducting planar member surrounding the push-buttons to illuminate the push-buttons, to an open position where the light admitting hole is now unobstructed so that light can illuminate directly the push-button switches.

SUMMARY OF THE INVENTION

An object of the present invention is to eliminate the problem encountered in the prior art remote controls by providing a simple lighting system incorporated into a remote control for intermittent lighting of the keys or push-button switches of the remote control, thus, to provide a remote control in which a user can easily find a desired control button in a dark place in order to press a key accurately to perform a desired function.

According to the teachings of the present invention there is provided a remote control for remote controlling an appliance from a place remote from the place of the appliance. The remote control comprises: a circuit board having circuits for performing various remote control functions, having a light emitting circuit including at least one light emitting element and having a plurality of spaced first contacts, one of which is associated with the light emitting circuit; a contact plate disposed over the circuit board and having a plurality of spaced apart second contacts which can individually and selectively be moved against one of the first contacts to close respective ones of the remote control circuits, the plurality of second contacts including a light actuation contact which selectively can be moved into contact with one of the first contacts associated with the lighting circuit for closing the light emitting circuit; the at least one light emitting element being disposed at a predetermined position on the circuit board to protrude upwardly from the circuit board and being connected into the light emitting circuit, the light emitting circuit being constructed and arranged to cause the light emitting element to emit light for several seconds at an activated state established when the light emitting circuit is closed by the first and second contacts associated with the light emitting circuit coming into contact with each other; the contact plate having at least one through hole therethrough adapted to allow light to pass upwardly therethrough from the light emitting element; a transparent or translucent elastomeric plate having, at an upper surface thereof, a plurality of upwardly protruding push-buttons corresponding respectively to the first contacts which overlie and correspond to the second contacts and having at, a lower surface thereof, a plurality of downwardly extending pressing projections; and, a transparent or translucent button fixing or locating plate having a plurality of through holes which receive and serve to fix, locate and guide each downwardly extending pressing projection against one of the first contacts to cause it to come into aligned contact with its associated second contact to ensure accurate closing of circuits, whereby, when the button associated with the first contact associated with the light emitting circuit is depressed to bring it into contact with its associated second contact, the light emitting circuit is closed and the light emitting element projects light against the transparent or translucent fixing plate which scatters light emitted from the light emitting element and the scattered light is spread along all of the transparent or translucent fixing plate and into the buttons thereby illuminating same to a user of the remote control.

BRIEF DESCRIPTION OF THE DRAWINGS

Other objects and aspects of the invention will become apparent from the following description of embodiments with reference to the accompanying drawings in which.

DESCRIPTION OF THE PREFERRED EMBODIMENT(S)

Figure 1:
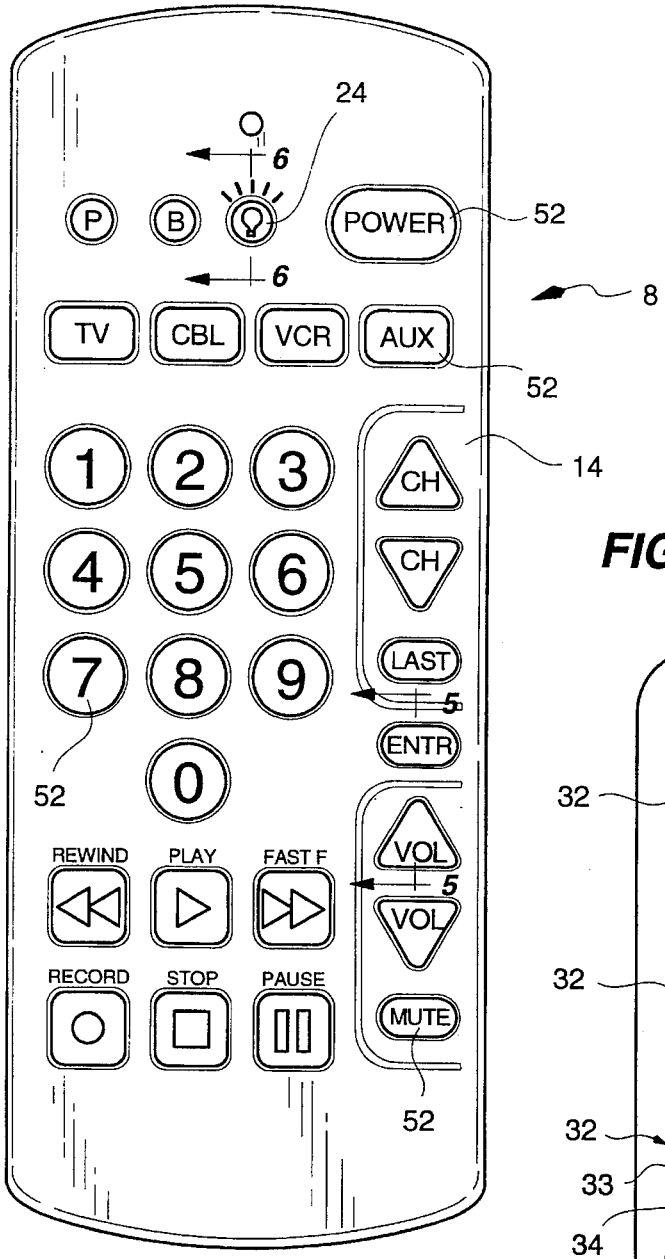
FIG. 1 is a top plan view of the remote control constructed according to the teachings of the present invention.

Referring to FIGS. 1–4, there is illustrated therein a remote control 8 constructed in accordance with the teachings of the present invention. The remote control 8 includes a lower case or bottom housing portion 10 (FIGS. 2 and 3) having a battery receiving chamber 12 and an upper case or top housing portion 14 having a plurality of push-button receiving holes 16 (FIG. 4) therein.

On the lower case 10, a circuit board 20 (FIG. 2) is seated which carries remote control circuits for various functions. The circuit board 20 is also provided with a plurality of light emitting elements, LED's 21, namely six (6) LED's 21, which protrude upwardly from an upper surface 22 of the circuit board 20. The light emitting elements 21 are connected with a lighting circuit on the circuit board 20. The lighting circuit is constructed and arranged to cause the light emitting elements 21 to emit light for several seconds upon pushing a light actuation push-button 24 extending upwardly from and being integral with an upper transparent or translucent elastomeric plate 26.

The circuit board also has a light signal emitting LED 27 mounted at an upper end of the circuit board 20.

Figure 2:
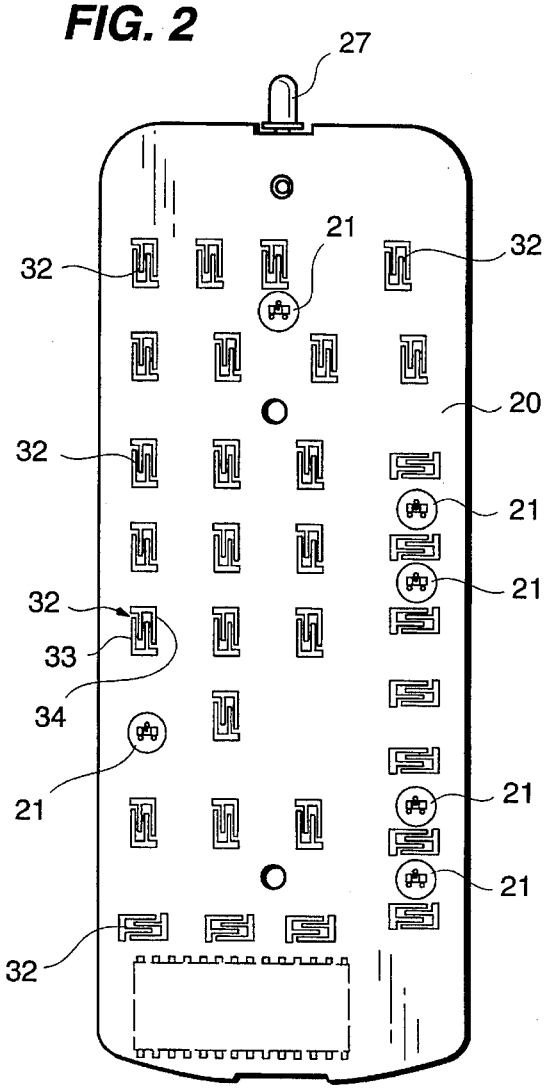
FIG. 2 is a top plan view of a circuit board mounted within the remote control shown in FIG. 1.

A spacer, insulating plate 28 with holes 29 (FIG. 4) therein is positioned above the circuit board 20 and a contact plate 30 is seated or positioned on the spacer plate 28. The contact plate 30 has a plurality of contacts 31 (which can be referred to as first or second contacts 31) adapted, respectively, to make contact with contacts 32 (which can be referred to as second or first contacts 32 and which each comprise two opposed F shaped interleaved conductive strips 33 and 34 on the upper surface 22 of the circuit board 20 as shown in FIG. 2) on the circuit board 20 to close corresponding remote control circuits on the circuit board 20. Only a few of the contacts 31 and 32 are shown, with exaggerated thickness, in FIG. 4. The holes 29 in the spacer plate 28 are in registry or aligned with the first and second contacts 31 and 32. The spacer plate 28 also has holes 35 aligned with the holes 36 in the contact plate 30 and each pair of aligned holes 35 and 36 are in registry with a respective one of the light emitting elements 21 on the circuit board 20. Each one of the LED's 21 protrudes upwardly through the pair of aligned holes 35 and 36.

Figure 3:
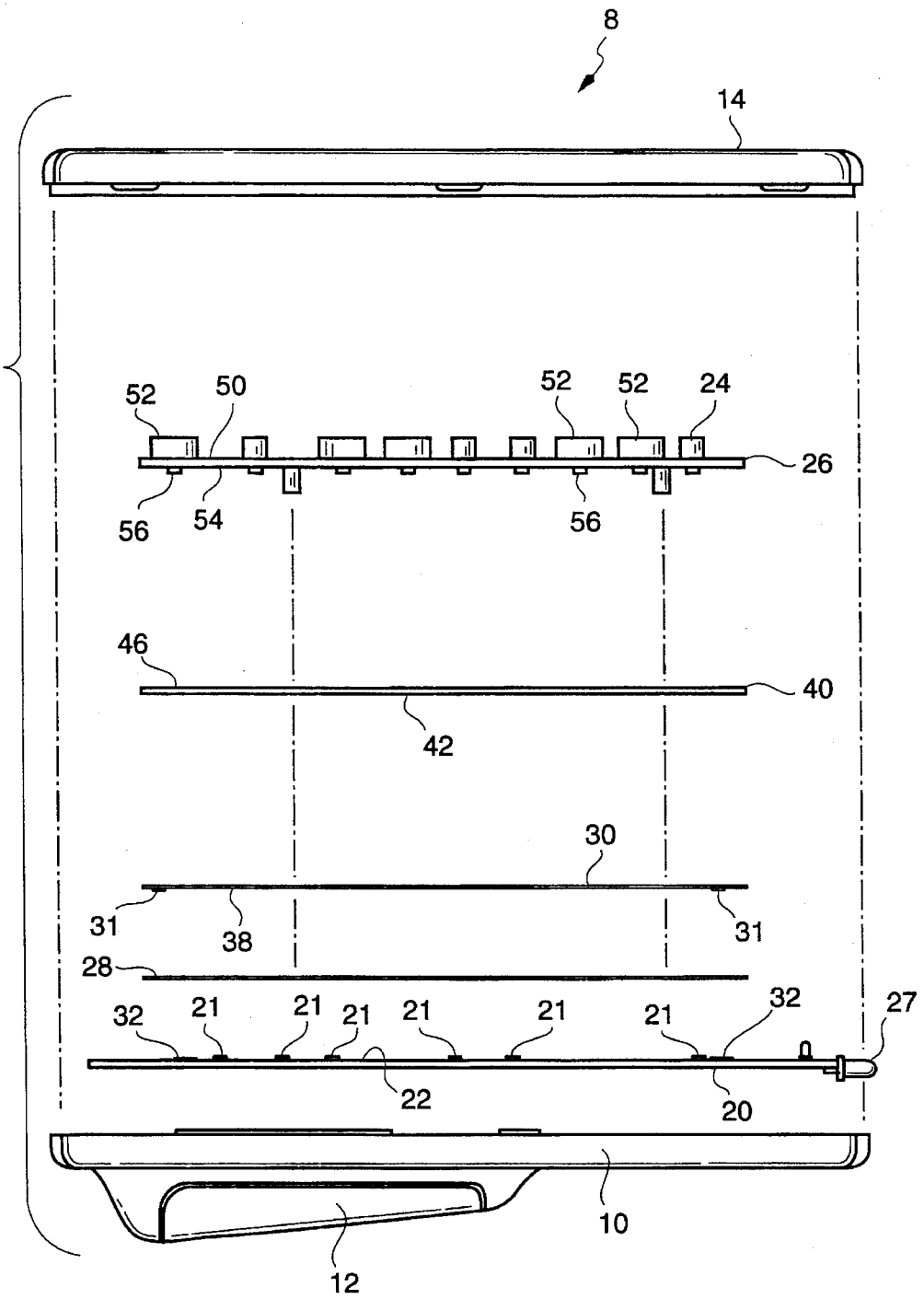
FIG. 3 is an exploded side view of the remote control shown in FIG. 1 and shows a bottom housing portion, the circuit board, four plates and a top housing portion.
Figure 4:
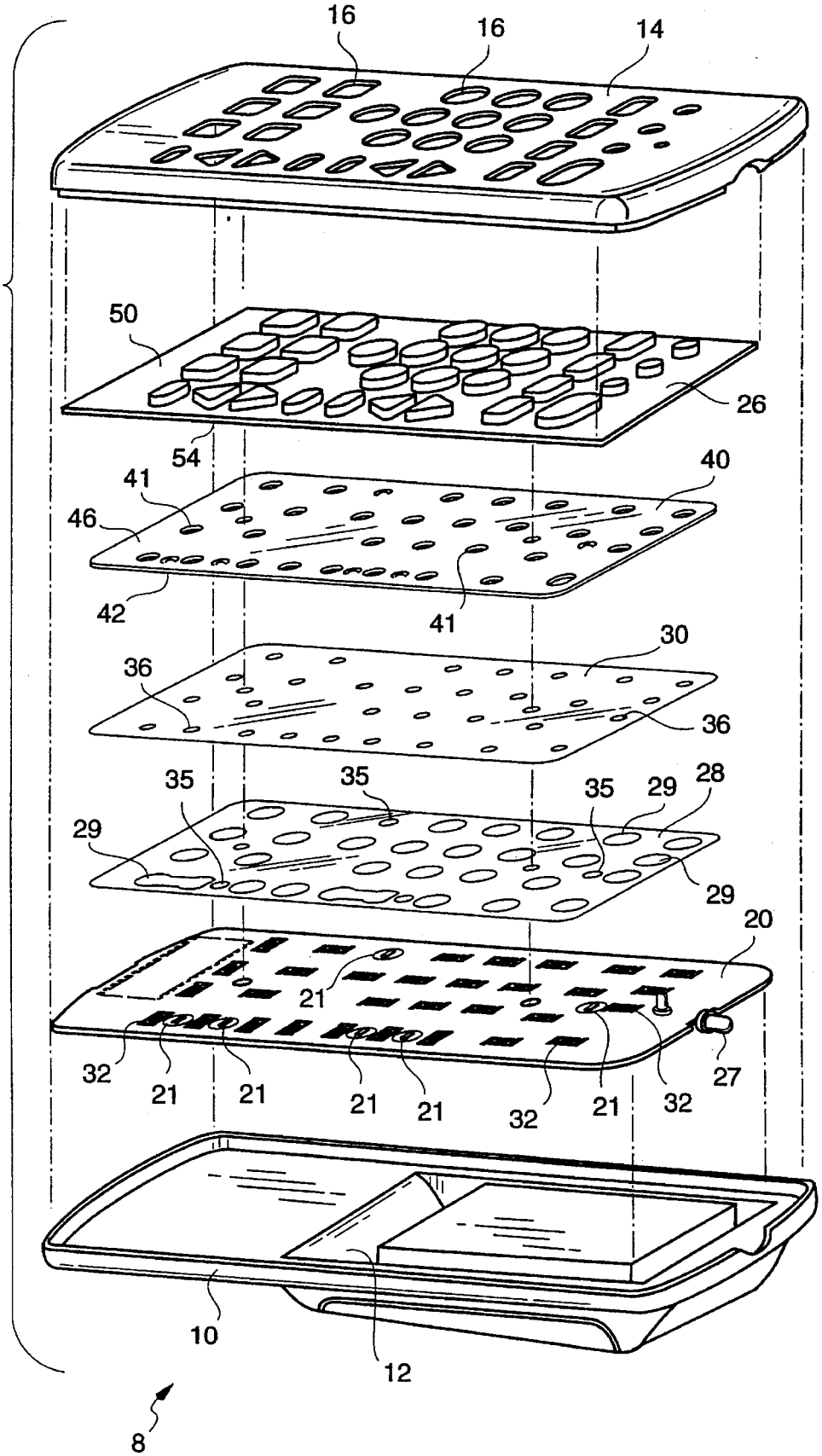
FIG. 4 is an exploded upper angular view of the bottom housing portion, the circuit board, the four plates and the top housing portion shown in FIG. 3.

As shown in FIG. 3, the first contacts 31 are mounted on an underside 38 of the contact plate 30.

Positioned over the contact plate 30, is a transparent or translucent push-button projection fixing, locating or guiding plate 40 which has a plurality of through holes 41 (FIG. 4) which are each aligned with, and positioned over one of, the first contacts 31. The push-button projection fixing plate 40 is also provided in its lower surface 42 with recesses or grooves 44 (FIGS. 5 and 6), more specifically, generally semi-spherical or partially spherical recesses 44, each receiving the protruded upper end of one of the corresponding light emitting elements 21. If desired, a reflective surface 45 having a generally circular extent can be positioned on an upper surface 46 of the fixing plate over each partially spherical recess 44.

The transparent or translucent, elastomeric or rubber plate 26 is seated on the push-button fixing plate 40. The elastomeric plate 26 has, on its upper surface 50, a plurality of upwardly protruded push-buttons 52 including the light actuation push-button 24 which extend upwardly through the holes 16 in the upper case 14 and, on its lower surface 54, a plurality of depending pressing projections 56, each aligned with a push-button 52 or the light actuation push-button 24 and extending downwardly through respective ones of the through holes 41 in the push-button projection fixing plate 40.

The light actuation push-button 24 is disposed at a position at the upper end of the upper case or top housing portion 14 allowing the user to easily find the light actuation push-button 24. The upper case 14 is disposed over the transparent or translucent elastomeric plate 50. The upper case 14 is coupled with the lower case 10 by means of screws. The upper case 16 has the plurality of holes 16 through which respective push-buttons 52 and 24 protrude upwardly.

Figure 5:
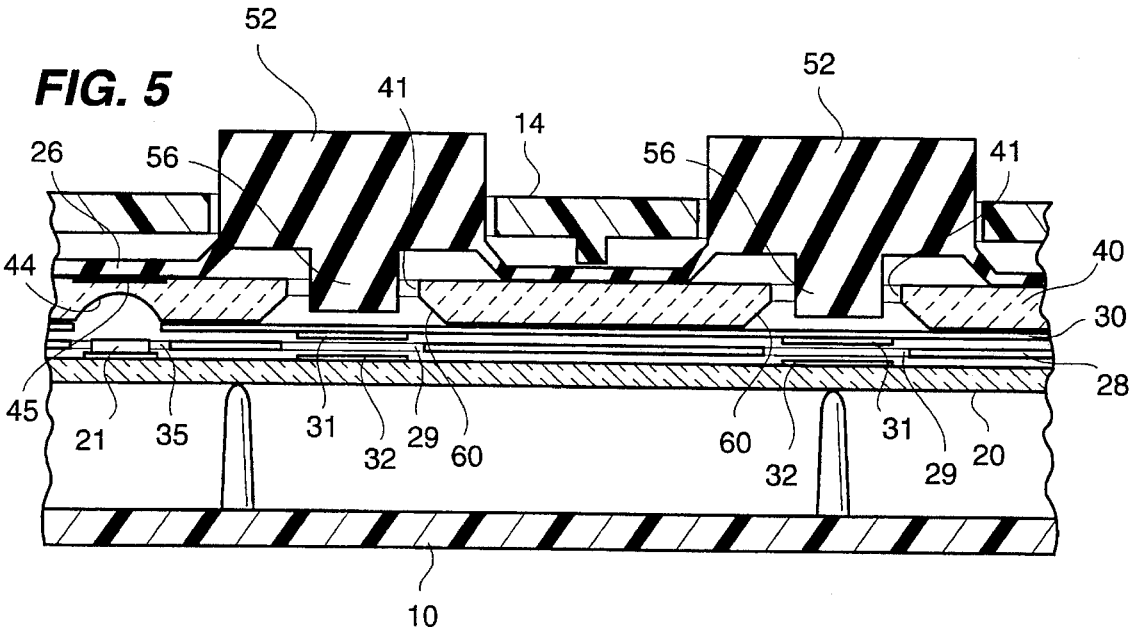
FIG. 5 is a fragmentary sectional view of two push-button switch assemblies and of one light emitting diode and is taken along line 5—5 of FIG. 1.

Looking now to FIG. 5, there is illustrated therein two push-button switch assemblies each including a push button 52 the push-button 52 on the left hand side of the figure being the "VOL" down push-button 52 and the push-button 52 on the right hand side of the figure being the "ENTER" push-button 52 as can be seen in FIG. 1. Each switch assembly includes an arrangement of a push-button 52, a depending pressing projection 56 extending downwardly through a hole 41 in the guiding plate 40, a first contact 31 and a contact 32. Each pressing projection 56 is positioned aligned with or in registry with a first contact 31 therebelow which is positioned above a second contact 32 on the circuit board 20.

As shown in FIG. 5, one LED 21 is each positioned beneath a partially spherical recess or groove 44 in the lower surface 42 of the fixing plate 40. Also, the openings 41 have a bevel or partially conical surface 60 defining the lower part of each opening 41. The bevel is shown with an exaggerated angle $\alpha$ to the horizontal which, in an actual embodiment, is approximately 2.75° for facilitating refraction of light into the depending pressing projection 56 of each push-button 52 and of the light actuation push-button 24 as shown in FIG. 6.

Figure 6:
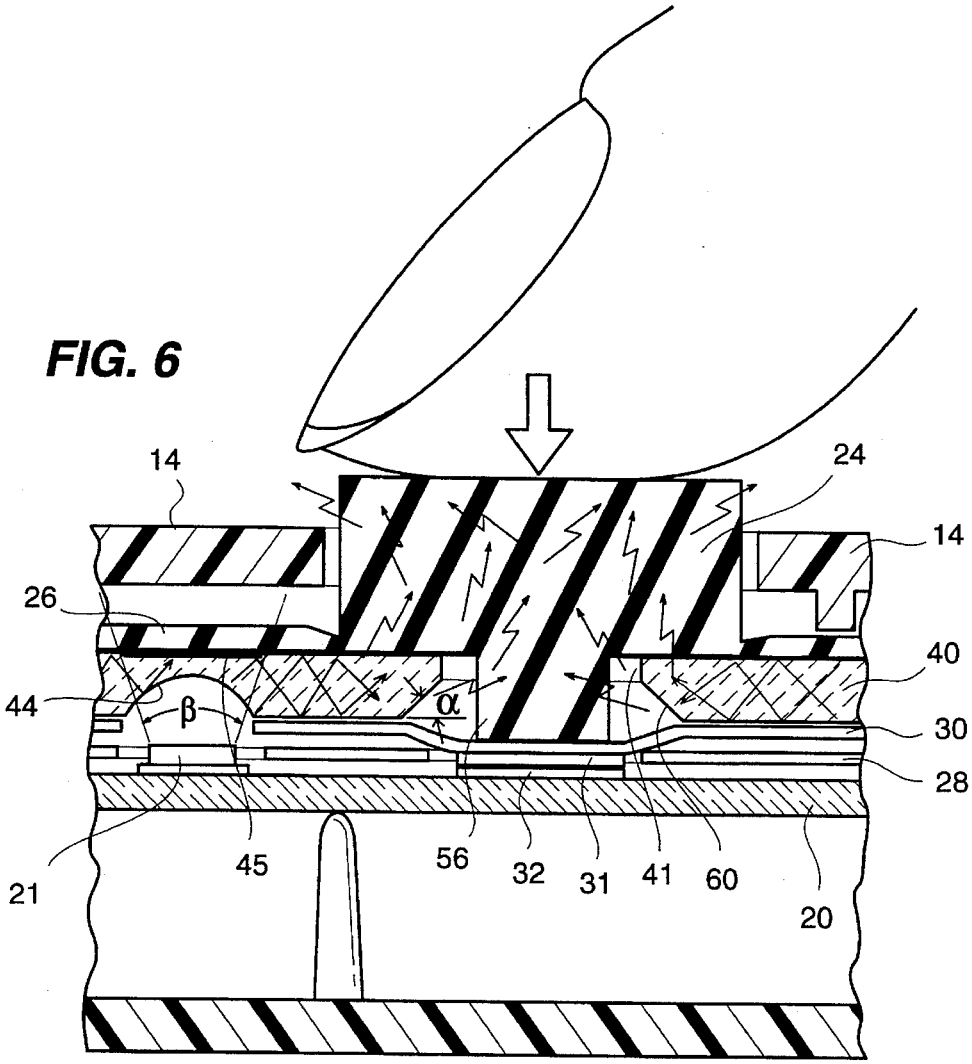
FIG. 6 is a fragmentary sectional view of a light actuating push-button switch assembly and one light emitting diode and is taken along line 6—6 of FIG. 1.

Also as shown in FIG. 6, each LED 21 is of the type that emits light therefrom in a cone defined by the angled β which is a conical, three dimensional angle of approximately 2π steradians for facilitating entry of light into the transparent or translucent fixing plate 40. From there, the light is reflected at the lower surface 42 and upper surface 46 of the plate 40. If the reflective surface 45 is provided as shown in FIGS. 5 and 6, light from the LED 21 can also be reflected by this light reflecting surface 45 into the transparent or translucent fixing plate 40 to facilitate the dispersion of light into the plate 40 and, as shown in FIG. 6, from the plate 40 into the transparent or translucent plate 26 and into the push-buttons 52 and the depending pressing projections 56 thereof.

OPERATION

The operation of the remote control 8 having the construction described above is described below:

When the remote control 8 is to be manipulated for remote controlling an electric appliance or mechanism in a dark place where symbols and numerals respectively indicated on the push-buttons 52 cannot be distinguished, the user first pushes the light actuation push-button 24 disposed at a position allowing the user to easily find the light actuation button 24. As the light actuation button 24 is pressed down, the pressing projection 56 disposed beneath the light actuation push-button 24 is pressed, thereby causing the first contact 31 disposed beneath the pressed pressing projection 56 to be pressed. Accordingly, the contact 31 comes into contact with the second contact 32 for the lighting circuit for the lighting elements 21 on the circuit board 20, thereby causing the lighting circuit to be closed. At the closed state of the lighting circuit, the lighting elements 21 emit light for several seconds, e.g., 2 to 10 seconds. The emitted light is scattered along the whole lower surface 42 of the push-button fixing plate 40. This light is then outwardly transmitted through the transparent or translucent elastomeric plate 26 and then through the push-buttons 52 and 24 protruding upwardly through the upper case 14. As a result, the user can distinguish the symbols and numerals indicated on the push-buttons 52 by the transmitted light. In this way, it easily is possible to find and push a desired push-button 52 for performing remote control of a desired function in a controlled appliance.

It is preferred that the light emitting elements 21 are activated only for several seconds, as stated above. This is because the battery may be early exhausted if the light emitting elements 21 are continuously activated.

As apparent from the above description, the present invention provides a remote control 8 with light emitting elements 21 that can be energized for a brief time to enable a user easily to find a desired control button 52 which is illuminated by light emitted from the light emitting elements 21 in a dark place or at night to enable a user to effect performance, accurately, a desired function by the controlled appliance.

Although preferred embodiments of the invention have been disclosed for illustrative purposes, those skilled in the art will appreciate that various modifications, additions and substitutions can be made to the remote control 8, without departing from the teachings of the present invention as defined in the accompanying claims.

I claim:

1. A remote control for remote controlling an appliance from a place remote from the place of the appliance, said remote control comprising:

a circuit board having circuits for performing various remote control functions, having a light emitting circuit including at least one light emitting element and having a plurality of spaced apart first contacts, said light emitting circuit including one of said first contacts;

a contact plate disposed over said circuit board and having a plurality of spaced apart second contacts which can individually and selectively be moved against one of said first contacts to close respective ones of said remote control circuits, said plurality of second contacts including a second contact associated with the light emitting circuit which selectively can be moved into contact with one of said first contacts associated with said lighting circuit for closing said light emitting circuit;

said at least one light emitting element being disposed at a predetermined position on said circuit board to protrude upwardly from said circuit board and being connected into said light emitting circuit, said light emitting circuit being constructed and arranged to cause said light emitting element to emit light for several seconds at an activated state that is established when said light emitting circuit is closed by said first and second contacts associated with said light emitting circuit coming into contact with each other;

said contact plate having at least one through hole therethrough adapted to allow light to pass upwardly therethrough from said light emitting element;

a transparent or translucent elastomeric plate having, at an upper surface thereof, a plurality of upwardly protruding buttons corresponding respectively to and positioned over said second contacts which overlie and correspond to said first contacts on said circuit board and having at, a lower surface thereof, a plurality of downwardly extending pressing projections, each located over a second contact; and, a transparent or translucent button fixing or locating plate having a plurality of through holes which receive and serve to fix, locate and guide each downwardly extending pressing projection against one of said second contacts to cause said second contact to come into aligned contact with its associated first contact on said circuit board to ensure accurate closing of each of said remote control circuits, whereby, when said button associated with said first and second contacts associated with said light emitting circuit is depressed to bring it into contact with its associated second contact, said light emitting circuit is closed and said light emitting element projects light against said transparent or translucent fixing plate which scatters light emitted from said light emitting element so that said scattered light is spread along all of said transparent or translucent fixing plate and into said buttons thereby illuminating same to a user of the remote control.

2. The remote control of claim 1 wherein said transparent or translucent button fixing plate is provided at a lower surface thereof with at least one recess for receiving an upper end of said light emitting element protruding upwardly through an associated aligned through hole in said contact plate.

3. The remote control of claim 2 wherein said lighting elements include at least six (6) light emitting diodes.

4. A hand held, battery operated remote control for controlling an appliance from a remote location, said remote control comprising: a housing having openings through an upper wall thereof; a plurality of transparent or translucent push-buttons each extending upwardly through one of said openings; one of said push-buttons being a light actuation button; a plurality of switch means each associated with one of said push-buttons; and a light emitting circuit located inside said housing and including at least one light emitting element positioned in said housing at a location not under a push button, light dispersing means for illuminating one or more of said push-buttons with light from said at least one light emitting element, and circuit means for maintaining said light emitting circuit activated for a short period of time after depression of said light actuation button.

5. The remote control of claim 4 including a circuit board having said light emitting circuit situated thereon and being mounted in said housing.

6. The remote control of claim 5 including a plurality of light emitting elements mounted at spaced apart locations on said circuit board.

7. The remote control of claim 6 wherein said plurality of light emitting elements include at least six (6) light emitting diodes.

8. The remote control of claim 5 including a transparent or translucent elastomeric plate having said push-buttons formed therein.

9. The remote control of claim 8 wherein said light dispersing means includes a transparent or translucent button fixing plate positioned beneath said elastomeric plate and having a plurality of holes therein, each locating beneath one of said push-buttons.

10. The remote control of claim 9 wherein said fixing plate has a lower surface with at least one recess therein and said light emitting element is mounted on said circuit board in a position facing said recess.

11. The remote control of claim 10 wherein said light emitting element emits light in a conical envelope which has an apex angle $\beta$ of approximately $2\pi$ steradians.

12. The remote control of claim 9 wherein each of said holes in said button fixing plate not only extends through said button fixing plate but also has a beveled or frusto-conical surface at the lower side thereof in said button fixing plate.

13. The remote control of claim 12 wherein said frusto-conical surface is defined by an angle $\alpha$ to the horizontal of approximately 2.75°.

14. The remote control of claim 5 including a contact plate positioned above said circuit board in said housing and having a plurality of spaced apart first contacts on a lower surface thereof and said circuit board having a plurality of second contacts on an upper surface thereof, each second contact being aligned with one of said first contacts, each first contact being aligned with one of said push-buttons, and each pair of aligned first and second contacts forming part of one of said switch means.

15. The remote control of claim 5 including a contact plate positioned above said circuit board in said housing and having a plurality of spaced apart first contacts on a lower surface thereof and said circuit board having a plurality of second contacts on an upper surface thereof, each second contact being aligned with one of said first contacts, each first contact being aligned with one of said push-buttons, and each pair of aligned first and second contacts forming part of one of said switch means and an insulating, spacer plate situated above said circuit board and between said circuit board and said contact plate.

16. The remote control of claim 15 including a transparent or translucent elastomeric plate having said push-buttons formed therein, a transparent or translucent button fixing plate positioned beneath said elastomeric plate and having a plurality of holes therein, each located beneath one of said push-buttons, and a projection depending from each push-button and adapted to extend through one of said holes in said fixing plate and against one of said first contacts on said contact plate.

* * * * *